US011053100B1

(12) United States Patent
O'Brien

(10) Patent No.: US 11,053,100 B1
(45) Date of Patent: Jul. 6, 2021

(54) CRANE WINCH ASSEMBLY STOWAGE AND MODE DETECTION SYSTEM AND METHOD

(71) Applicant: Altec Industries, Inc., Birmingham, AL (US)

(72) Inventor: Shawn D. O'Brien, Hermantown, MN (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 17/094,251

(22) Filed: Nov. 10, 2020

(51) Int. Cl.
*B66C 13/50* (2006.01)
*B66C 13/46* (2006.01)

(52) U.S. Cl.
CPC ..... *B66C 13/50* (2013.01); *B66C 13/46* (2013.01)

(58) Field of Classification Search
CPC ..... B66C 13/00; B66C 13/18; B66C 13/46; B66C 13/50; B66C 15/00; B66C 23/88
See application file for complete search history.

(56) References Cited

U.S. PATENT DOCUMENTS 4,434,901 A * 3/1984 Gehl ..... B66C 23/94 212/276
4,600,353 A * 7/1986 Phillips, Jr. ..... B60P 3/125 280/402
7,489,098 B2 * 2/2009 Harris ..... B66C 23/80 212/277
7,683,564 B2 * 3/2010 Harris ..... B66C 23/80 318/565
8,813,981 B2 8/2014 Ethington
10,221,048 B2 * 3/2019 Aus ..... B66C 23/701
2007/0089925 A1 * 4/2007 Addleman ..... B66D 1/46 180/313
2008/0019815 A1 * 1/2008 Harris ..... B66C 23/80 414/563
2008/0038106 A1 * 2/2008 Spain ..... B66C 23/80 414/563
2012/0199543 A1 8/2012 Bell et al.
2012/0199544 A1 * 8/2012 Aus ..... B66C 23/64 212/299

* cited by examiner

*Primary Examiner* — Michael R Mansen
*Assistant Examiner* — Juan J Campos, Jr.
(74) *Attorney, Agent, or Firm* — Erise IP, P.A.

(57) ABSTRACT

A system and method for detecting a configuration of a crane winch assembly and activating a mode of operation of an aerial device based at least in part on the configuration is shown and described herein. The aerial device may comprise a crane winch assembly with a sensor for detecting that the crane winch assembly is stowed or deployed. When the crane winch assembly is deployed, a crane mode of the aerial device may be active. When the crane winch assembly is stowed, an aerial mode of the aerial device may be active. Further, certain operations of the aerial device may be active and inactive based on an anti-two block system of the aerial device.

20 Claims, 7 Drawing Sheets

CRANE WINCH ASSEMBLY STOWAGE AND MODE DETECTION SYSTEM AND METHOD

BACKGROUND

1. Field

Embodiments of the invention relate to operational mode switching of an aerial device. Specifically, embodiments of the invention relate to operational mode switching of an aerial device based at least in part on a configuration of a crane winch assembly.

2. Related Art

In typical crane systems and aerial devices that are adaptable for use in a crane mode, an operator controls a winch system to lift a load with a boom on the crane. When the winch is raised, an anti-two block system is utilized to prevent collision of a load or a load block with components at the end of the boom. The load is then placed at a desired location and the winch is stowed. When the winch is stowed, an anti-two block flag may be manually placed on the anti-two block sensor to disable the anti-two block system. The anti-two block system may be disabled to stow the winch or to utilize the boom for alternative operations of the aerial device.

One problem with the current systems is that the operator is required to manually install the anti-two block flag. With some aerial devices, the aerial devices are adaptable to be operated in a plurality of modes. A few exemplary modes may be as a crane mode, a material handler mode, a utility platform mode for power line operations, and more. These operations may require the anti-two block system to be disabled. Consequently, an operator of the aerial device may only spend a small amount of time (e.g., 10% of the operational time of the aerial device) in crane mode where the anti-two block system is active. Therefore, the operator may have little experience manually switching between crane mode and the other modes. Further, the operator may have little experience disabling the anti-two block system with the anti-two block flag. Lack of experience may result in the anti-two block flag being installed incorrectly or not being installed at all which may result in malfunction of aerial device operations and damage to the boom.

More importantly, when the aerial device is in crane mode, the anti-two block flag must be removed manually or the anti-two block system may remain disabled during crane mode operation. When the inexperienced operator forgets to remove the flag, the load may be drawn up and the load may impact components of the winch and the aerial device causing damage.

Further, the inexperienced operator may attempt to pay in the winch cable while the winch is stowed. The winch may be stowed when not in crane mode or when unintentionally in crane mode. Alternatively, the operator may pay in the winch when the winch is attached to the boom causing damage to the boom and the winch.

Further still, the operator must switch to and from crane mode manually. Switching between different modes results in different safety features being enabled and disabled. Consequently, if the operator forgets to switch to crane mode but utilizes the winch, the wrong safety features may be disabled resulting in damage or malfunction of the aerial device.

What is needed is a system and method for automatically switching modes and activating safety features depending on whether the winch is stowed or not. In some embodiments, a crane mode may be activated when a sensor detects that the winch is not stowed and a second mode of the aerial device may be activated enabling other safety features when the winch is stowed. The automatic activation of safety features and mode switching leads to a system that is not dependent on the operator to switch modes and activate safety features.

SUMMARY

Embodiments of the invention solve the above-mentioned problems by providing a system that determines the state of a crane winch assembly. A first embodiment of the invention is directed to a crane mode detection system for detecting a configuration of a crane winch assembly and activating a mode of operation of an aerial device based at least in part on the detected configuration, comprising a winch pin for connecting a winch cable, a sensor connected to the winch pin, said sensor configured to detect the connection of the winch cable and send a first signal indicative of the winch cable connection, a controller configured to receive the first signal from the sensor and send a second signal to the aerial device, and at least one actuator configured to receive the second signal and actuate an operation of the aerial device based on the second signal, wherein the second signal is indicative of a mode of operation of the aerial device.

A second embodiment of the invention is directed to a method of detecting a configuration of a crane winch assembly and activating a mode of operation of an aerial device based at least in part on the configuration, the method comprising the steps of: connecting a winch cable to a winch pin by a winch hook, detecting, by a sensor, the connection of the winch hook and sending a first signal indicative of the winch hook connection, receiving, by at least one processor, the first signal from the sensor, and sending, by the at least one processor, a second signal that changes a mode of operation from a crane mode to an aerial mode.

A third embodiment of the invention is directed to a crane winch stowage assembly for connecting and stowing a crane winch on a boom of an aerial device, comprising a winch pin for connecting to a winch hook, a bracket connected to the winch pin and configured to connect to the boom of the aerial device, a spring disposed in the bracket and configured to compress when a winch hook is connected to the winch pin, said winch hook being connected to a winch cable, and a sensor for detecting movement of the winch pin when the winch cable is retracted and the spring is compressed, wherein the winch hook is configured to support a load at a distal end of the boom when the winch hook is not connected to the winch pin.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
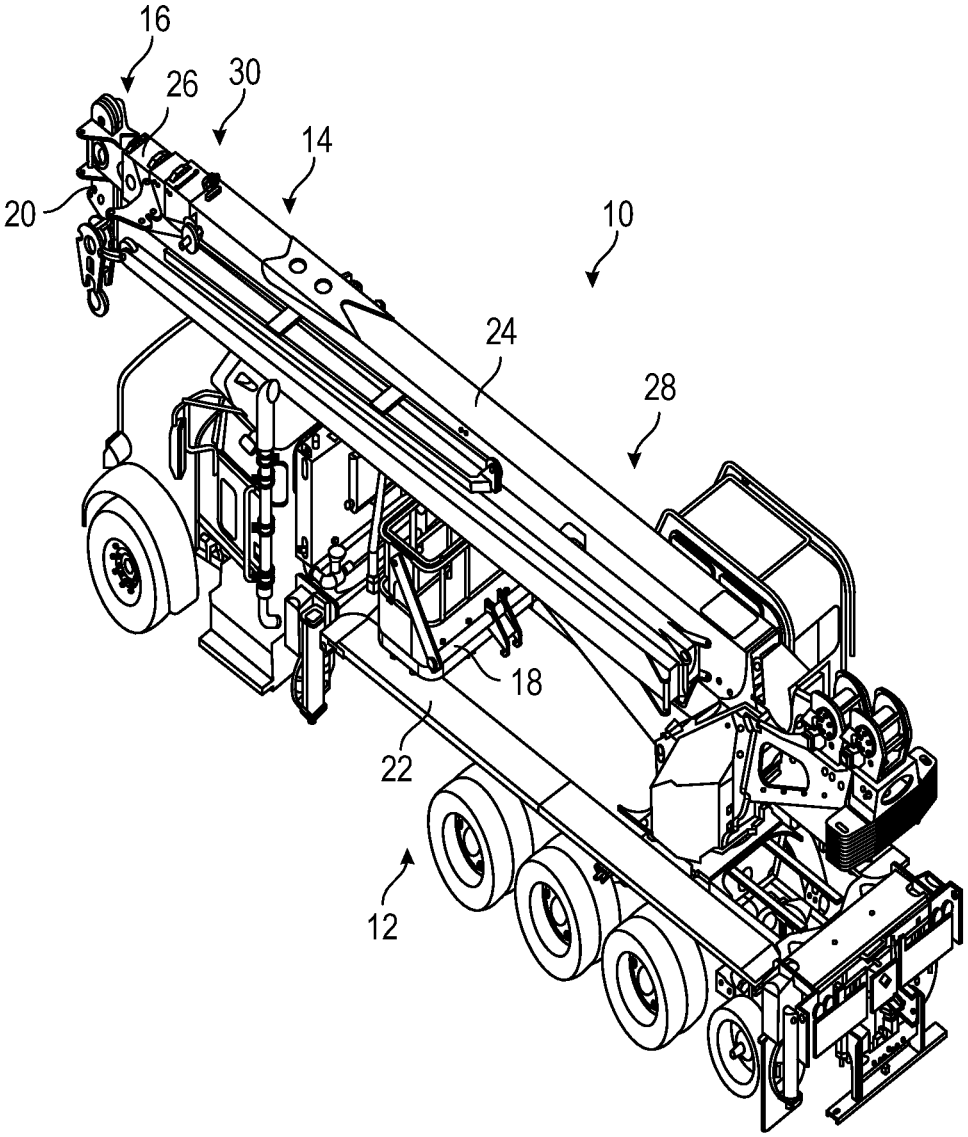
FIG. 1 is a perspective view of an aerial device with a crane winch assembly stowage and mode detection system.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Figure 2:
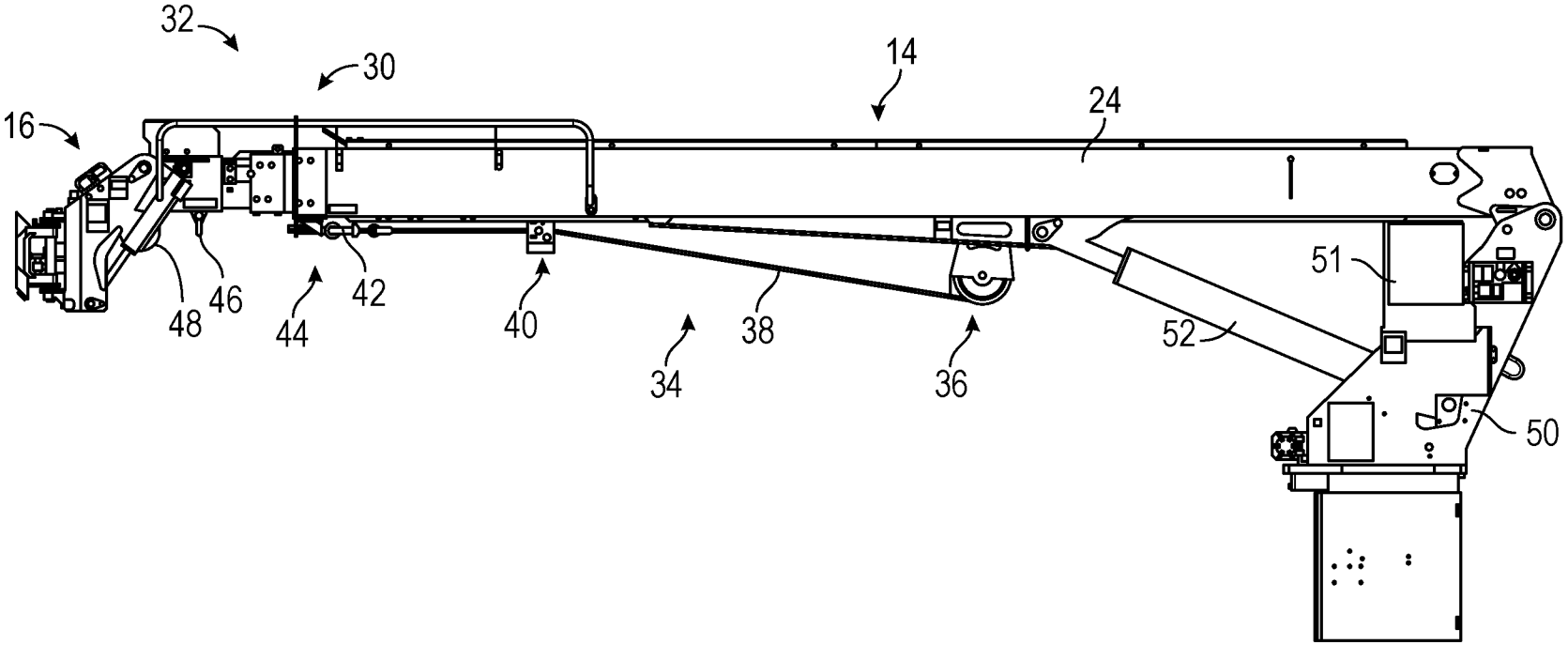
FIG. 2 is a side view of an embodiment of the aerial device with a winch cable in a stowed position.

An aerial device 10, constructed in accordance with various embodiments of the invention, is shown in FIG. 1. The aerial device 10 generally comprises a base 12 with a boom assembly 14 rotatably mounted thereto. An implement 16, such as a utility platform assembly 18 (stowed on the bed), a crane implement 20, or other implement for performing work, is disposed on the boom assembly 14 to facilitate the accomplishment of a task by a utility worker. The implement 16 may be secured to the boom assembly 14 via an adapter or a boom turret. The adapter provides for quick and easy coupling of the utility platform assembly 18. In some embodiments, a crane winch assembly 34 may be attached to an under side of the boom assembly 14 as shown in FIG. 2. This allows for the crane winch assembly 34 to be attached while various implements may be added to the end of the boom assembly 14.

The base 12 of the aerial device 10 is a selectively stabilized platform. In embodiments of the invention, the base 12 is a utility truck 22 (as illustrated in FIG. 1), a crane base, an oil rig, an earth-working machine, or a fixed structure. The base 12 provides stability and a counterweight to a load being supported by the boom assembly 14. Larger loads could require a more stable and a heavier base. To achieve this stability, in embodiments of the invention, the base 12 may utilize hydraulic stabilizers, outriggers, and/or sandbags.

The boom assembly 14 broadly comprises an outer boom section 24 and at least one inner boom section 26. The boom assembly 14 presents a proximal end 28 and a distal end 30. The proximal end 28 is rotatably and/or pivotably secured to a portion of the base 12. The distal end 30 is secured to the implement 16 (the crane implement 20 as shown). The at least one inner boom section 26 is at least in part disposed within the outer boom section 24. The at least one inner boom section 26 telescopes to extend or retract into the outer boom section 24. In embodiments of the invention, the boom assembly 14 may comprise additional equipment including any of the following: power lines for the routing of hydraulic, pneumatic, or electrical power; communication wires for user-controls located on the boom assembly 14; or support cables (not illustrated). In some embodiments of the invention, the boom assembly 14 comprises a first boom section rotatably secured to the base 12 and a second boom section rotatably secured to a distal end of the first boom section (not illustrated). In still other boom assemblies, a combination of the telescoping and pivoting boom sections is utilized.

The at least one inner boom section 26 may telescope into a plurality of positions with respect to the outer boom section 24, including a fully retracted position, in which the length of the body of the at least one inner boom section 26 is substantially inserted within the outer boom section 24, and a fully extended position, in which only a relatively small portion of the length of the body of the at least one inner boom section 26 is inserted within the outer boom section 24.

Generally, the aerial device 10 may be operated in various modes. For example, the aerial device 10 may be operable to act as a utility platform. The utility platform assembly 18 may be attached to the distal end 30 of the boom assembly 14. The boom assembly 14 may be raised and lowered by the operator freely with any safety features for the aerial device 10 enabled. The crane winch assembly 34 may comprise cables and hooks for attaching and lifting loads. The cables and hooks may be stowed or mounted to the under-side of the boom assembly 14 such that the utility platform assembly 18 may be attached to the distal end 30 of the boom assembly 14. The mode of the aerial device 10 may be changed from a crane mode to an aerial mode to enable certain safety features and operations as described in detail below.

Alternatively the boom implement 16 of the aerial device 10 may be a material handler, a tree felling device, and any other implement that may be utilized by the aerial device 10. When the aerial device 10 is configured for use with the various implements, the winch assembly may be stowed. As such, when the crane winch assembly 34 is stowed, the aerial device 10 may be in an aerial mode. The aerial mode may generally reference any mode that is used to operate any implements other than the crane winch assembly 34. When the crane winch assembly 34 is stowed, the mode switching system may automatically be set to the aerial mode and, as such, may not be in a crane mode. While the mode switching system is not in the crane mode, the crane winch assembly 34 functions may be disabled. For example, power to the winch motor may be reduced or disabled. Therefore, the motor is at a reduced output or no output such that the winch may not be payed in. This may prevent damage to the boom and the winch assembly by not allowing the operator to unintentionally pay in the winch while the winch is in the stowed configuration.

Generally, controls for use with the aerial device may be active or inactive based on the mode. User inputs may be disposed in the utility truck 22 and in the utility platform assembly 18. Further, wireless remote controls may be used. The user inputs may comprise a single set of controls that may switch between crane mode and aerial mode or may comprise two separate sets of controls, one for aerial mode and one for crane mode. Either way, when the aerial device 10 is in crane mode, only the set of controls for operating the crane winch assembly 34 will be operable, and when the aerial device 10 is in aerial mode, the controls for the crane winch assembly 34 will be inactive. As such, the crane winch assembly 34 will not be operable when the crane cable and block are in a stowed configuration.

FIG. 2 depicts an embodiment of a crane section 32 of the aerial device 10. The crane section 32 may comprise the boom assembly 14 and the crane winch assembly 34. Further, the crane winch assembly 34 is shown in a stowed configuration and comprises a spool 36, a winch cable 38, a pulley block 40, a winch hook 42, a stowage and detection assembly 44, an eyelet 46, and a pulley 48. FIG. 2 depicts the winch cable 38 in the stowed configuration. The crane winch assembly 34 is shown in greater detail in FIGS. 3-4 and the winch stowage and detection assembly 44 is shown in more detail in FIG. 4 below. In some embodiments, the boom assembly 14 may be controlled by the user at the cabin 51 of the utility truck 22. The cabin 51 may be disposed on a turret 50 as depicted or at the aerial device 10 base 12. In some embodiments, the boom assembly 14 may be controlled to rotate and extend and the crane winch assembly 34 may be controlled by a user transmitting the commands remotely. The boom assembly 14 may rotate about the turret 50 and extend by the hydraulic cylinder 52. In some embodiments, the boom assembly 14 may comprise a plurality of sections with a plurality of hydraulic cylinders for extension of the plurality of sections. The crane winch assembly 34 may be positioned on any of the plurality of boom sections. Further, any of the hydraulic controls may be operated by a controller during change of operational modes of the aerial device 10.

Figure 6:
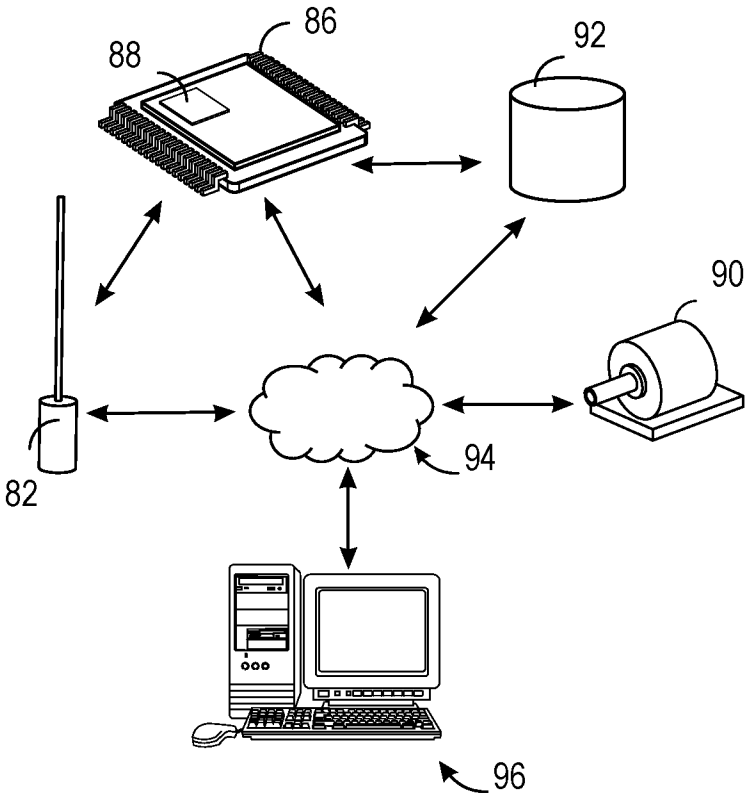
FIG. 6 depicts an exemplary hardware system for embodiments of the invention.

In some embodiments, the winch cable 38 is reeled around the spool 36. The spool 36 may be controlled by electric, hydraulic, and/or pneumatic energy. The spool 36 may be operated by a controller 86 controlling the flow of energy to rotate the spool 36. The controller 86 is shown in FIG. 6 and described in detail below. The spool 36 may rotate winding the winch cable 38 around the spool 36 to pay in the winch cable 38, raising the load. In some embodiments, the spool 36 may be controlled by the user to rotate the spool 36 to unwind the winch cable 38 to lower the load. In some embodiments, the spool 36 may be controlled by a motor that is controlled by the controller 86 automatically using computer-executable instructions stored on non-transitory computer-readable media based at least in part on a detection of the configuration of the crane winch assembly 34 (stowed or deployed).

In a deployed position, in some embodiments, the winch cable 38 runs through the eyelet 46 and is supported by the pulley 48. The pulley 48 is disposed at the distal end 30 of the boom assembly 14 and supports the load. The pulley 48 rotates when the winch cable 38 is retracted and advanced.

Figure 3:
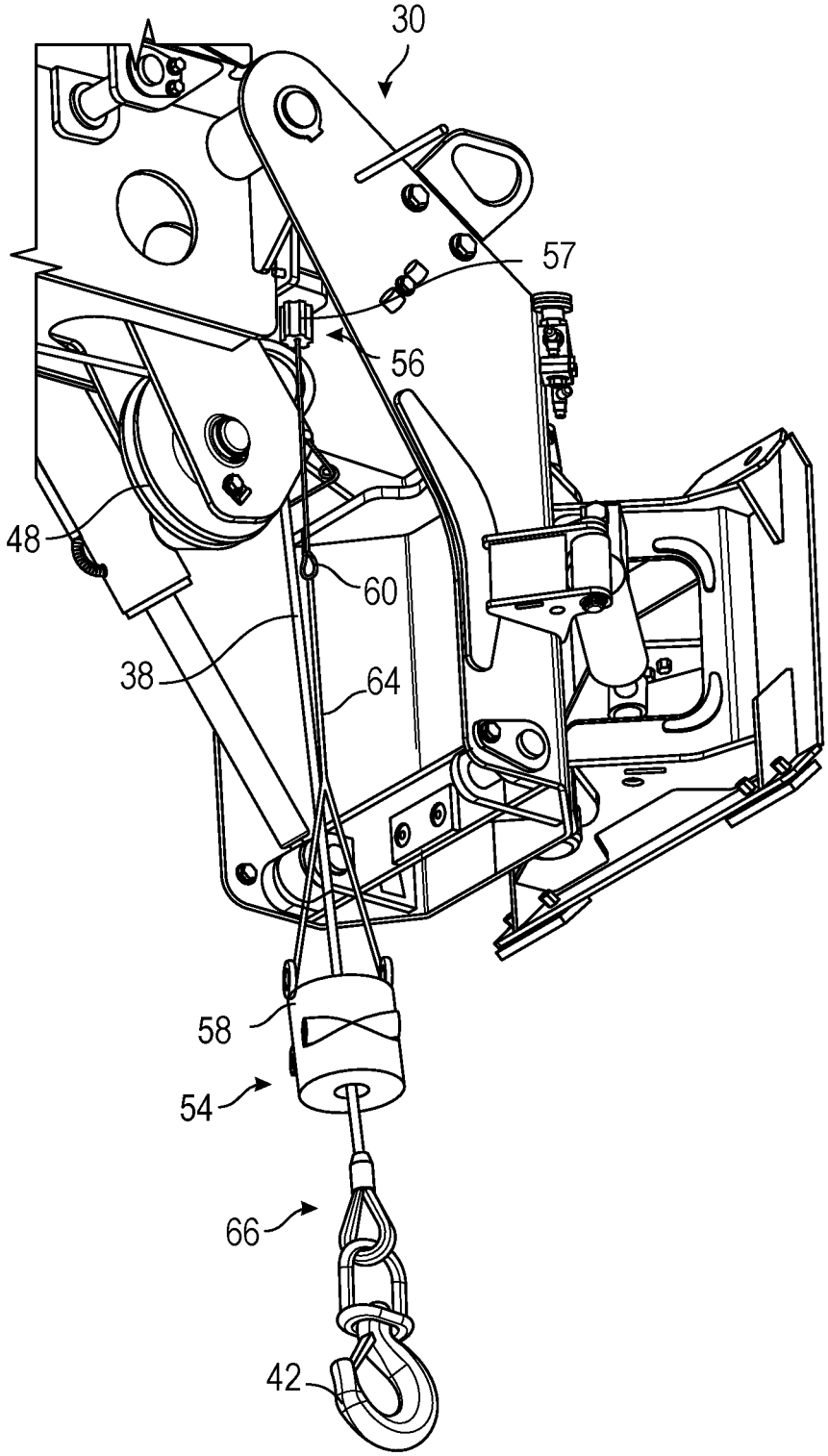
FIG. 3 depicts an embodiment of the aerial device with a winch cable in the deployed position.

FIG. 3 depicts the distal end 30 of the boom assembly 14 with the winch cable 38 in the deployed position. The winch hook 42 may attach to a load and the winch cable 38 may be retracted, winding the winch cable 38 around the spool 36 lifting the load.

As depicted, the crane winch assembly 34 further comprises an anti-two block system 54. The anti-two block system 54 may comprise an upper block 56 and a lower block 58. Two blocking is when the winch hook 42 is raised until the winch hook 42, load, or any other part of a lower attachment assembly 66 contacts a component of the distal end 30 of the boom assembly 14 or another part of the crane winch assembly 34 such as, for example, the pulley 48. Two blocking may result in damage to the boom assembly 14 components, the crane winch assembly 34, and the load. In some cases the load may detach or the winch cable 38 may break loose causing the load to fall. Typically, the anti-two block system 54 is required by most safety oversight organizations.

In some embodiments, the anti-two block system 54 comprises the lower block 58 and an upper block 56 with a block attachment 60 that supports the lower block 58 with block cables 64. The winch cable 38 slides through the lower block 58 while raising and lowering the load. When a lower attachment assembly 66 is raised and contacts the lower block 58, the weight of the lower block 58 is removed from the block attachment 60 that is connected to the upper block 56. An anti-two block sensor 57 at the upper block 56 detects the weight change and sends a signal to the controller 86 that stops the movement of the winch cable 38. In some embodiments, the anti-two block sensor 57 is a switch. The controller 86 may send a signal to an electric motor or an actuator to actuate a hydraulic or pneumatic valve. In some embodiments, other crane operations (e.g., winch raise, boom lower, boom extend, boom rotate, etc.) may also be deactivated when the anti-two block system 54 detects that the lower block 58 is in contact with the lower attachment assembly 66.

Figure 4:
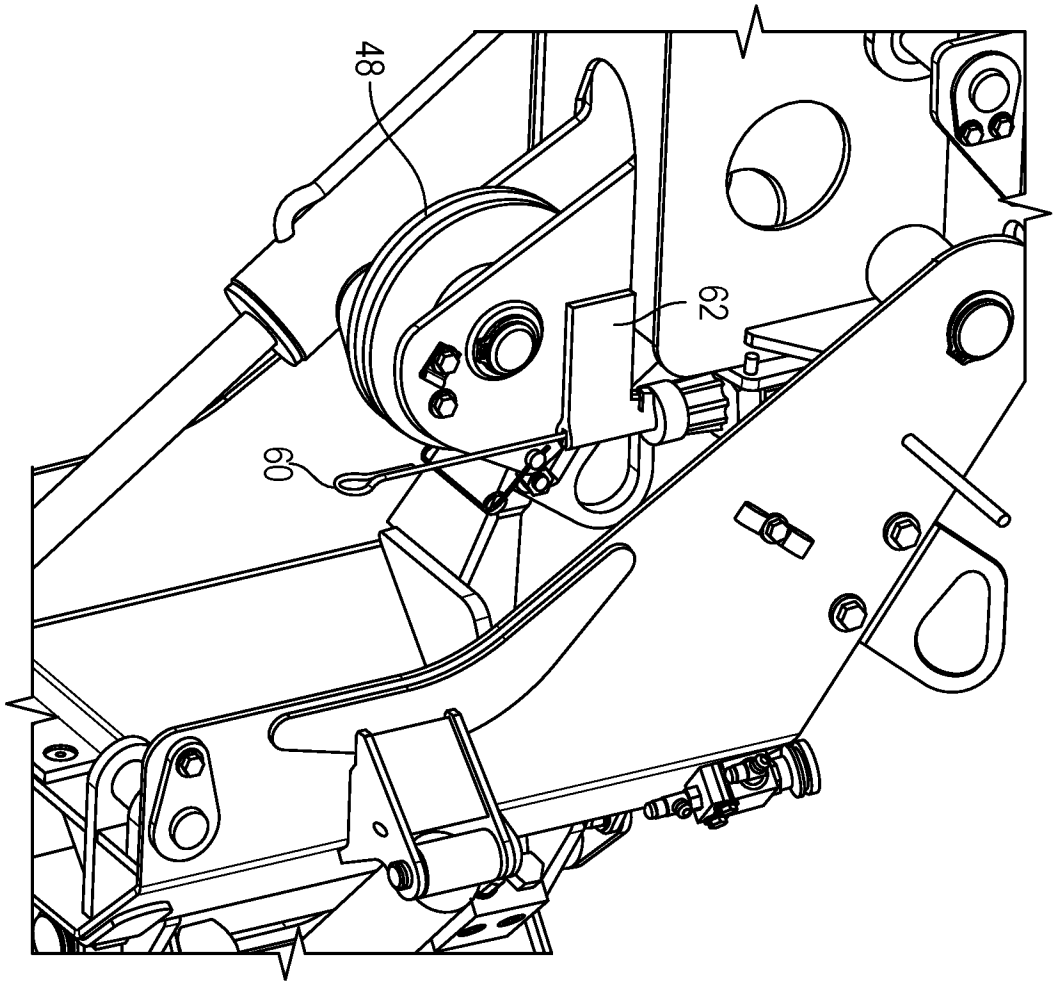
FIG. 4 depicts a close-up view of an embodiment of an anti-two block system with an anti-two block flag installed.

In some embodiments, the anti-two block system 54 may comprise an anti-two block flag 62 for disabling the anti-two block system 54 as depicted in FIG. 4. The anti-two block flag 62 may prevent the block attachment 60 from triggering the anti-two block sensor 57 in the upper block 56. The anti-two block flag 62 effectively bypasses the anti-two block system 54 making all of the above-described functions that would normally be disabled operable.

As shown in FIG. 4, the anti-two block flag 62 is a mechanical device that may be attached to the upper block 56. A common problem with the anti-two block system 54 is that crane operators may forget to remove the anti-two block flag 62. When the anti-two block flag 62 is not removed, the load may be attached to the winch hook 42 and the winch cable 38 may be payed in too far. The load, lower attachment assembly 66, lower block 58, and any other component may contact and damage the boom assembly 14 when the anti-two block flag 62 is installed.

Typically, the operator must manually attach and remove the anti-two block flag 62 for various mode operations of the aerial device 10. First, the operator may retract the winch cable 38. The winch cable 38 may stop based on the desired distance set by the anti-two block system 54. The operator then places the anti-two block flag 62 on the upper block sensor 57 disabling the anti-two block system 54 such that the operator may stow the crane winch assembly 34. The operator then stows the crane winch assembly 34 as shown in FIG. 2.

A further problem with this process and system, as described above, is that the operator must manually switch from crane mode to aerial mode and vice versa. If the operator forgets to switch the operational mode of the aerial device 10, the operator may pay in the winch cable 38 while the winch hook 42 is stowed causing damage to the crane winch assembly 34 and the boom assembly 14.

Figure 5:
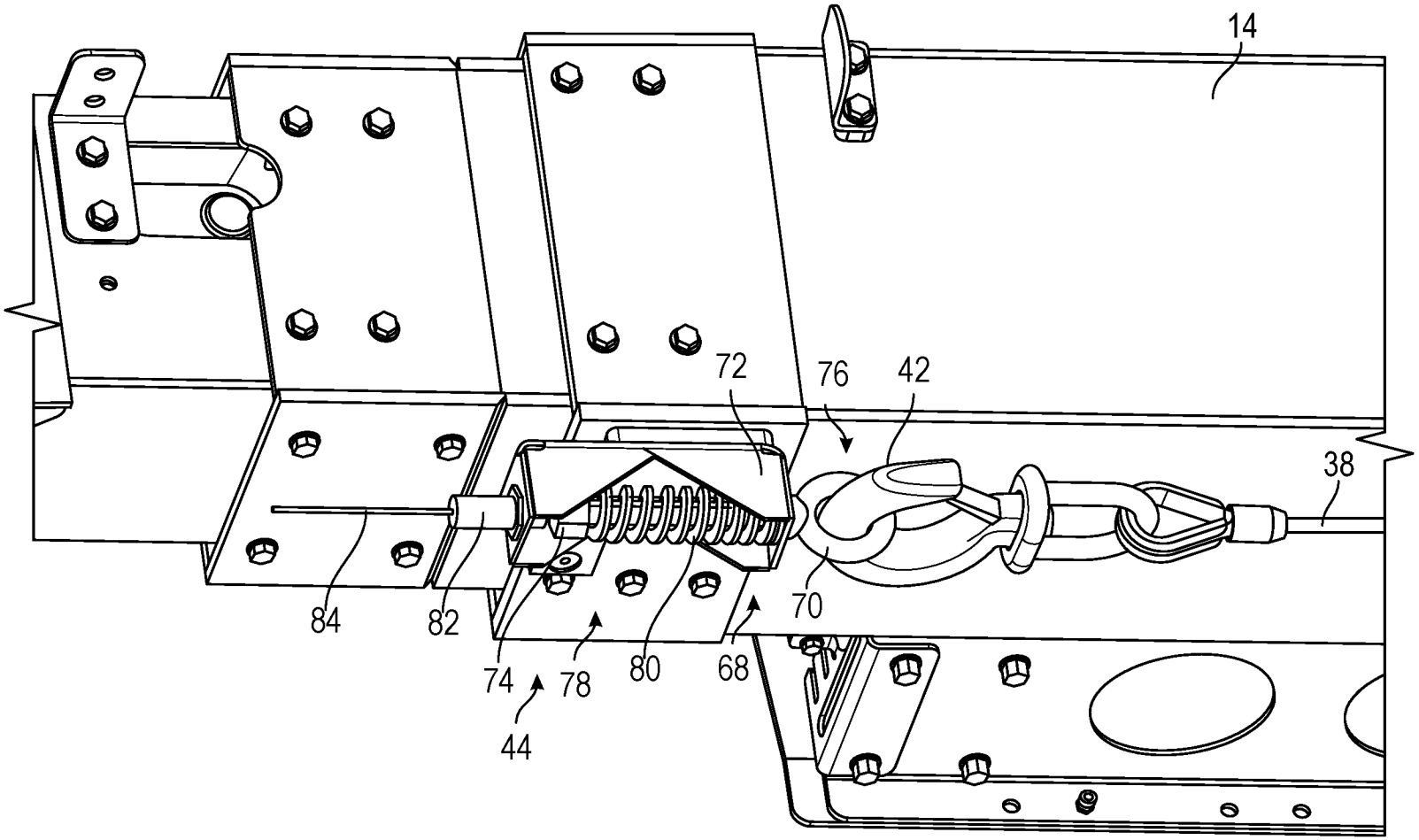
FIG. 5 depicts the winch cable attached to an embodiment of the crane winch assembly stowage and mode detection system.

FIG. 5 depicts a close-up view of the stowage and detection assembly 44 comprising the winch stow system 68. In some embodiments, the winch stow system 68 comprises a stowage pin 70 for attaching the winch hook 42 at a proximal end 76 of the stowage pin 70. The stowage pin 70 may extend through a bracket 72 that is attached to the boom assembly 14. The stowage pin 70 may also comprise threads with a nut 74 screwed onto a distal end 78 of the stowage pin 70. A spring 80 may be disposed between the nut 74 and the bracket 72. In an exemplary embodiment, when the crane winch assembly 34 is in the stowed position, the winch hook 42 is connected to the stowage pin 70 and pulls against the force of the spring 80. The spring 80 may be compressed such that the nut 74 attached to the stowage pin 70 is separated from a sensor 82. When the nut 74 is either not touching or at a minimum pre-defined distance from the sensor 82, the sensor 82 sends a signal indicative of the crane winch assembly 34 being in the stowed position and the crane mode is switched off. Conversely, when the winch hook 42 is not connected to the stowage pin 70, the nut 74 is either touching or in close proximity to the sensor 82, and a signal is sent from the sensor 82 to the controller 86 indicative of the crane winch assembly 34 being in the deployed position.

In some embodiments, when the winch hook 42 is disconnected from the stowage pin 70 and the sensor 82 detects that the crane winch assembly 34 is in the deployed position, a signal to activate the anti-two block system 54 (depicted in FIGS. 3-4) is sent. The anti-two block system 54 may be deactivated when the crane winch assembly 34 is stowed (in aerial mode) and active when the crane winch assembly 34 is deployed (in crane mode). Control of the anti-two block system 54 may be based on the state of the crane winch assembly 34 and enable automatic safety systems to be in place. Consequently, the burden of manual activation of the anti-two block system 54 by the operator is reduced.

In some embodiments, the stowage pin 70 may be a metal pin configured to be attached to the winch hook 42. In some embodiments, the stowage pin 70 may have a single loop as shown or may be a carabiner, hook, and any other type of attachment device at its proximal end 76. In some embodiments, the spring 80 may be any spring with a known spring constant such that a known force will compress the spring 80 when tension is added to the winch cable 38.

In some embodiments, the sensor 82 may be a switch. The switch may be activated when the nut 74 is in contact with the switch. When the nut 74 is in contact with the switch, a signal indicative of the deployed crane winch assembly 34 is sent to the controller 86 and the controller 86 activates the crane mode by sending a second signal to the various instruments of the aerial device 10 to be active or inactive during the current operational mode. When the nut 74 is not in contact with the switch, a signal indicative of the crane winch assembly 34 being in a stowed configuration is sent to the controller 86. The controller 86 then activates aerial modes such as, for example, material handler mode, digger derrick mode, tree feller mode, and utility platform mode as described above. Alternatively, in some embodiments, when the nut 74 contacts the switch, the crane winch assembly 34 is stowed and the controller 86 activates aerial modes. When the nut 74 does not contact the switch, the crane winch assembly 34 may be deployed and the controller 86 activates crane mode. Any processes of activating and deactivating the different modes may be imagined.

In some embodiments, the sensor 82 is a proximity sensor. When the nut 74 is in close proximity to the sensor 82, the sensor 82 may send a signal indicative of the crane winch assembly 34 in the deployed position to the controller 86. The controller 86 may then activate the crane mode. When the nut 74 is a minimum distance from the sensor 82, the sensor 82 may send a signal indicative of the crane winch assembly 34 being in the stowed configuration to the controller 86. The controller 86 may then activate aerial modes. Alternatively, in some embodiments, when the nut 74 is in close proximity to the sensor 82, the crane winch assembly 34 is stowed and the aerial modes are active. When the nut 74 is a minimum distance from the sensor 82, the crane winch assembly 34 is deployed and crane mode is active.

In some embodiments, the nut 74 may not be necessary and the sensor 82 may instead detect the stowage pin 70, the spring 80, and any other part of the winch stow system 68 for determining if the crane winch assembly 34 is stowed or deployed.

In some embodiments, the sensor 82 is connected to the controller 86 through wired communication. In some embodiments, the sensor 82 comprises an antenna 84 for wireless communication. The output of the sensor 82 may be transmitted to the controller 86 anywhere on the aerial device 10 as well as a remote location for monitoring.

FIG. 6 depicts exemplary hardware for carrying out embodiments described herein. In some embodiments, the controller 86 may be and otherwise may comprise at least one processor 88 for processing computer-executable instructions stored on at least one non-transitory computer-readable media. The controller 86 may receive the first signal from the sensor 82, which may be a switch or a proximity sensor as described above. Further, the controller 86 may receive the first signal from the anti-two block sensor 57 for controlling the operational modes of the aerial device 10. The first signal may be indicative of the state of the crane winch assembly 34 (i.e., stowed or deployed) or the configuration of the anti-two block system 54. The controller 86 may send at least one second signal actuating at least one actuator 90 associated with the operations of the aerial device 10 for controlling the operational modes of the aerial device 10 as described above. The at least one actuator 90 is exemplary and may be electronics such as a relay switch for controlling electrical current to and from components of the aerial device 10. In some embodiments, safety features are controlled via the second signal from the controller 86. For example, when the crane winch assembly 34 is stowed, the controller 86 sends a signal disabling the operation of the motor that controls the spool 36. In some embodiments, the motor may only operate at limited capacity or not be operable. In some embodiments, the motor may be controlled by a hydraulic valve that may be operated by the signal from the controller 86.

In some embodiments, the controller 86 may activate or deactivate the aerial device 10 operations in accordance with the state of the crane winch assembly 34. For example, any operations of the user input controls may be activated or deactivated. In some exemplary embodiments, when the crane winch assembly 34 is stowed, the aerial device 10 is in aerial mode and the controls in the utility platform assembly 18 are enabled. In some embodiments, the operations of winch raise, boom lower, boom extend, and boom rotate are disabled when the aerial device 10 is in crane mode and the anti-two block system 54 detects close proximity of the lower attachment assembly 66. In some embodiments, the anti-two block system 54 is disabled automatically when the crane winch assembly 34 is detected by the sensor 82 to be in a stowed position. Automatic switching of the operational modes of the aerial device 10 ensures that the aerial device 10 is in the proper mode determined by the controller 86 and the sensor 82 detecting the state of the crane winch assembly 34 and the anti-two block system 54.

Using the mode switching system, the controller 86 may automatically switch to aerial mode from crane mode utilizing all safety systems with the addition of overriding the input from the anti-two block system 54. This allows the operator to use the aerial device 10 in aerial modes when it is determined by the sensor 82 and the controller 86 that the winch is in the stowed position. Even in the event that the operator does not attach the anti-two block flag 62, when the crane winch assembly 34 is stowed, the sensor 82 may detect components of the crane winch assembly 34 and send a signal to the controller 86 indicative of the stowed configuration. The aerial device 10 is switch to any aerial modes. Therefore, the crane winch assembly 34 may not be mistakenly moved by the operator when the lower attachment assembly 66 is stowed, regardless of the position of the anti-two block flag 62. Further, alternative operations may be enabled based on the stowed position of the crane winch assembly 34 as described above.

In some embodiments, the first signal from the sensor 82 is sent to a controller 86. The controller 86, or at least one processor 88, may access computer-executable instructions stored on non-transitory computer-readable media. The second signal may be sent from the controller 86 to the at least one actuator 90 to turn on and off engines and to open and close valves to control electromechanical, pneumatic, and hydraulic devices. Consequently, the crane winch assembly 34 and boom assembly 14 operations may be controlled based on the detection of the crane winch assembly 34 by the sensor 82.

In some embodiments, the operations and any historic information as well as the non-transitory computer-readable instructions may be stored at a database 92. The sensor 82, controller 86, the database 92, and the at least one actuator 90 may communicate over local or remote network 94 and may communicate with computer 96. Computer 96 may be any processing unit that may be on the aerial device 10 or at a remote location. The network 94 may be any local closed network or, in some embodiments, may be the Internet.

In some embodiments, a notification is sent to the operator when the mode of operation is changed or when the anti-two block system 54 is activated. The sensor 82 and the anti-two block sensor 57 sends a signal to the controller 86 based on the configuration of the crane winch assembly 34 and a proximity of the lower attachment assembly 66 as detected as described above. The sensor 82 and anti-two block sensor 57 may communicate wirelessly to transmit signals to operate alerts or notifications. The alerts and notifications may be sent to an alarm on the aerial device 10 or to a mobile device of the operator. The alerts and notifications may notify the operator of the operational mode of the aerial device 10 such that the operator knows what mode the aerial device 10 is in and may operate the aerial device 10 in the known mode of operation.

Figure 7:
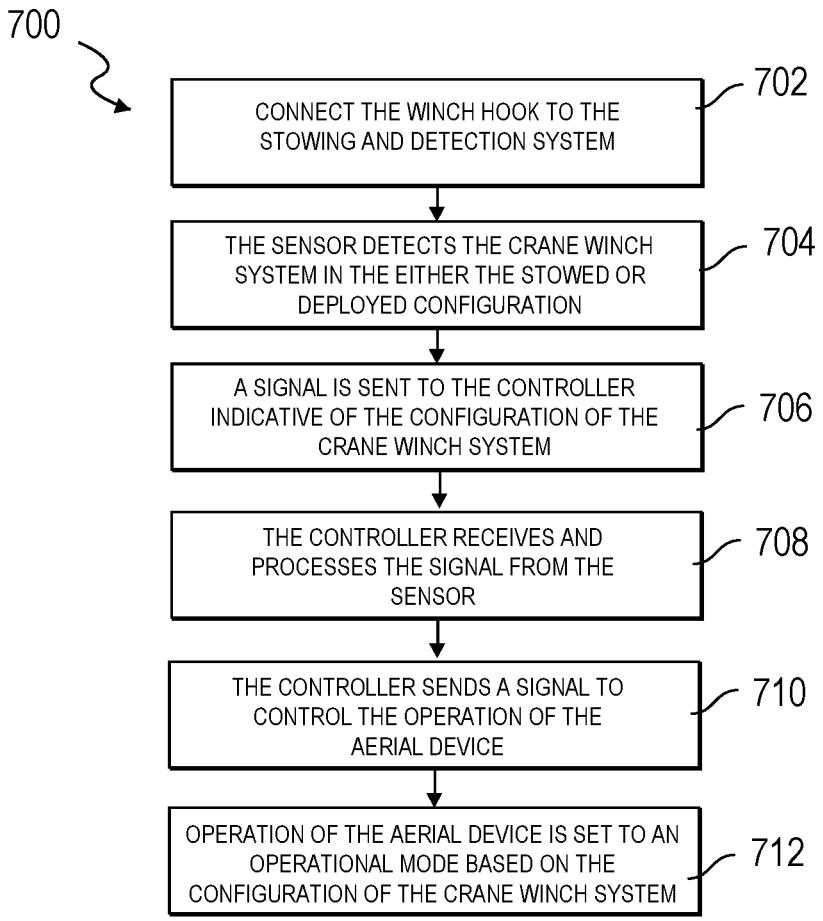
FIG. 7 depicts an exemplary flow chart for detecting a configuration of the crane winch assembly and thereby determining a mode of the aerial device.

FIG. 7 depicts an exemplary process of detecting the configuration of the crane winch assembly 34 and controlling the mode of the aerial device 10, generally referenced by the numeral 700. At step 702, the winch hook 42 is connected to the stowage pin 70. The stowage pin 70 extends through the bracket 72 and may be connected to the nut 74. The spring 80 may be disposed around the stowage pin 70 and held between the bracket 72 and the nut 74. When the winch hook 42 is connected to the stowage pin 70 and reeled in, the spring 80 compresses. When the spring 80 compresses, the stowage pin 70 moves away from the sensor 82 deactivating crane mode.

At step 704, the sensor 82 detects either the stowed configuration or the deployed configuration of the crane winch assembly 34. In some embodiments, the sensor 82 may be a switch. When the spring 80 is compressed and the stowage pin 70 is removed from the switch, a signal indicative of the configuration of the crane winch assembly 34 may be sent to the controller 86. In some embodiments, the switch may send the signal when the stowage pin 70 or nut 74 is pressed against the switch. In some embodiments, a signal may be sent in both configurations.

In some embodiments, the sensor 82 is a proximity sensor and the sensor 82 detects the proximity of the stowage pin 70 or nut 74 to the sensor 82. A signal indicative of the proximity of the stowage pin 70 or nut 74 may be sent to the controller 86 for controlling the mode of operation of the aerial device 10 as described in embodiments above.

In some embodiments, the connection of the winch hook 42 to the stowage pin 70 is detected by the sensor 82. Connection of the winch hook 42 to the stowage pin 70 indicates that the crane winch assembly 34 is stowed. When the winch hook 42 is not connected to the stowage pin, the crane winch assembly 34 is deployed.

At step 706, in some embodiments, the sensor 82 sends a signal indicative of the configuration of the crane winch assembly 34 (e.g., stowed or in operation). The sensor 82 may send the signal to the controller 86 for controlling the state of the aerial device 10.

At step 708, the controller 86 receives the signal indicative of the stowed crane winch assembly 34. The controller 86 may comprise at least one processor 88 and access one or more non-transitory computer readable media storing computer-executable instructions that, when executed by the at least one processor 88, performs a method of receiving the signal, determining a configuration of the winch, and sending a signal for operation of at least one actuator 90, activating and deactivating controls, sounding alarms, and sending notifications. Further, the signal from the controller 86 may change the operational mode of the aerial device 10.

At step 710, the controller 86 sends a signal for controlling the operational mode of the aerial device 10. In some embodiments, the signal may control the at least one actuator 90 associated with a valve or a motor for controlling any electrical, pneumatic, and hydraulic devices on the aerial device 10.

At step 712, operation of the aerial device is set to an operational mode based on the configuration of the crane winch system. In some embodiments, the signal from the controller may limit or provide power to and restrict or allow the motion of the boom assembly 14, the spool 36, the base 12, any lights, vehicle operations, alerts, and any other operations associated with the aerial device 10 as described in embodiments above. Further, when the crane winch assembly 34 is stowed and the aerial device 10 is in aerial mode, the anti-two block system 54 is inactive. When the crane winch assembly 34 is deployed and the aerial device 10 is in crane mode, the anti-two block system 54 is active.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A crane mode detection system for detecting a configuration of a crane winch assembly and activating a mode of operation of an aerial device based at least in part on the detected configuration, comprising:

a winch pin for connecting a winch cable;

a sensor connected to the winch pin, said sensor configured to detect the connection of the winch cable and send a first signal indicative of the winch cable connection;

a controller configured to receive the first signal from the sensor and send a second signal to the aerial device; and at least one actuator configured to receive the second signal and actuate an operation of the aerial device based on the second signal, wherein the second signal is indicative of a mode of operation of the aerial device.

2. The system of claim 1, further comprising a spring surrounding the winch pin and disposed between a winch bracket and a winch pin nut, wherein the spring is in a compressed state when the winch is stowed.

3. The system of claim 1, wherein the sensor is a proximity sensor, wherein the proximity sensor detects a proximity of the winch pin, and wherein the mode of operation is determined by the proximity of the winch pin to the proximity sensor.

4. The system of claim 1, wherein the sensor is a switch, wherein the switch is activated when at least one of the winch pin and a nut connected to the winch pin contact the switch, and wherein the mode of operation is determined by a contact of the at least one of the winch pin and the nut with the switch.

5. The system of claim 4, wherein the at least one actuator actuates a hydraulic valve for operation of a spool when the sensor detects that the mode of operation is a crane mode.

6. The system of claim 4, wherein an anti-two block system is activated when the mode of operation is a crane mode.

7. The system of claim 4, wherein an anti-two block system is disabled when the mode of operation is not a crane mode.

8. The system of claim 1, wherein the mode of operation is a crane mode when the winch is not stowed.

9. A method of detecting a configuration of a crane winch assembly and activating a mode of operation of an aerial device based at least in part on the configuration, the method comprising the steps of:

providing a crane mode detection system comprising:

a winch pin for connecting a winch cable, a sensor connected to the winch pin, and a controller;

connecting the winch cable to the winch pin by a winch hook;

detecting, by the sensor, the connection of the winch cable by the winch hook and sending a first signal indicative of the winch hook connection;

receiving, by the controller, the first signal from the sensor; and sending, by the controller, a second signal that changes a mode of operation from a crane mode to an aerial mode.

10. The method of claim 9, wherein the aerial mode is at least one of a material handler mode, a digger derrick mode, a tree felling mode, and a utility platform mode.

11. The method of claim 9, further comprising the steps of:

detecting contact of the winch hook to a lower block of an anti-two block system; and deactivating at least one operation of an aerial device based on the contact.

12. The method of claim 11, wherein the at least one operation of the aerial device is at least one of a winch raise, a boom lower, a boom extend, and a boom rotate.

13. The method of claim 9, further comprising the step of actuating at least one actuator based on the second signal, wherein the at least one actuator actuates a hydraulic valve closed when the sensor detects that the mode of operation is a crane mode.

14. The method of claim 9, further comprising activating an anti-two block system when the mode of operation is a crane mode.

15. The method of claim 9, further comprising disabling an anti-two block system when the mode of operation is not a crane mode.

16. A crane mode detection system for detecting a configuration of a crane winch assembly and activating a mode of operation of an aerial device based at least in part on the detected configuration, comprising:

a winch pin for connecting to a winch hook;

a bracket connected to the winch pin and configured to connect to a boom of the aerial device;

a spring disposed in the bracket and configured to compress when the winch hook is connected to the winch pin, said winch hook being connected to a winch cable;

a sensor connected to the winch pin for detecting movement of the winch pin when the winch cable is retracted and the spring is compressed, and sending a first signal indicative of the movement of the winch pin, wherein the winch hook is configured to support a load at a distal end of the boom when the winch hook is not connected to the winch pin; and a controller for receiving the first signal from the sensor and sending a second signal to the aerial device, wherein a mode of operation of the aerial device is changed based on the second signal.

17. The system of claim 16, further comprising: at least one actuator configured to receive the second signal and actuate an operation of the aerial device based on the second signal.

18. The system of claim 16, further comprising:

an anti-two block system comprising:

a lower block;

an upper block;

at least one cable connecting the upper block and the lower block; and an anti-two block sensor associated with the upper block;

wherein at least one operation of the aerial device is deactivated based on detection of the winch hook in proximity to the lower block, and wherein the at least one operation of the aerial device is at least one of a winch raise operation, a boom lower operation, a boom extend operation, and a boom rotate operation.

19. The system of claim 18, wherein the anti-two block system is activated when the mode of operation is a crane mode, and wherein the anti-two block system is disabled when the mode of operation is not the crane mode.

20. The system claim 16, wherein the mode of operation is at least one of a crane mode, a material handler mode, a digger derrick mode, a tree felling mode, and a utility platform mode.

* * * * *